US009484688B2

(12) United States Patent
Hügel et al.

(10) Patent No.: US 9,484,688 B2
(45) Date of Patent: Nov. 1, 2016

(54) PRINTED CIRCUIT BOARD COAXIAL CONNECTOR

(71) Applicants: Ulf Hügel, Herisau (CH); Martin Wagner, Steinach (CH)

(72) Inventors: Ulf Hügel, Herisau (CH); Martin Wagner, Steinach (CH)

(73) Assignee: HUBERT+SUHNER AG, Herisau (CH)

( * ) Notice: Subject to any disclaimer, the term of this patent is extended or adjusted under 35 U.S.C. 154(b) by 0 days.

(21) Appl. No.: 14/390,121

(22) PCT Filed: Apr. 3, 2013

(86) PCT No.: PCT/EP2013/056999

§ 371 (c)(1),
(2) Date: Oct. 2, 2014

(87) PCT Pub. No.: WO2013/150059

PCT Pub. Date: Oct. 10, 2013

(65) Prior Publication Data

US 2015/0118899 A1 Apr. 30, 2015

(30) Foreign Application Priority Data

Apr. 5, 2012 (CH) ..... 0487/12

(51) Int. Cl.
*H01R 24/54* (2011.01)
*H01R 9/05* (2006.01)
*H01R 12/91* (2011.01)

(52) U.S. Cl.
CPC ..... *H01R 24/54* (2013.01); *H01R 9/0515* (2013.01); *H01R 12/91* (2013.01); *H01R 24/542* (2013.01)

(58) Field of Classification Search
CPC ..... H01R 24/54; H01R 24/542; H01R 12/91
USPC ..... 439/271–275, 578, 63, 581, 8, 65, 439/246–248
See application file for complete search history.

(56) References Cited

U.S. PATENT DOCUMENTS

| | | | | |
|---|---|---|---|---|
| 4,808,115 | A * | 2/1989 | Norton et al. | 439/79 |
| 4,824,399 | A | 4/1989 | Bogar et al. | |
| 4,925,403 | A | 5/1990 | Zorzy | |
| 5,197,899 | A * | 3/1993 | Akeda | 439/271 |
| 5,879,177 | A | 3/1999 | Honma | |
| 5,980,290 | A | 11/1999 | Meynier et al. | |
| 6,174,206 | B1 | 1/2001 | Yentile et al. | |
| 6,224,421 | B1 * | 5/2001 | Maturo, Jr. | 439/581 |
| 6,402,538 | B2 * | 6/2002 | Suzuki | 439/271 |
| 6,497,579 | B1 * | 12/2002 | Garbini | 439/63 |
| 7,816,925 | B1 | 10/2010 | Gale | |
| 8,801,459 | B2 * | 8/2014 | Mrowka | 439/578 |
| 2004/0038586 | A1 | 2/2004 | Hall et al. | |
| 2005/0215113 | A1 | 9/2005 | Khemakhem | |
| 2006/0194465 | A1 * | 8/2006 | Czikora | 439/248 |
| 2007/0026698 | A1 | 2/2007 | Rosenberger | |

FOREIGN PATENT DOCUMENTS

| | | | |
|---|---|---|---|
| CN | 2879475 | Y | 3/2007 |
| CN | 101459304 | A | 6/2009 |

(Continued)

*Primary Examiner* — Briggitte R Hammond
(74) *Attorney, Agent, or Firm* — Pauley Erickson & Kottis

(57) ABSTRACT

The invention relates to a coaxial connector (1) having a first and a second connector part (2, 3) and an adapter (4) arranged between said connector parts. When installed, the adapter (4) is arranged in an opening (6) in an external conductor (8) of the first connector part (2, 3) such that it can fold out laterally. A limiting element (9) made from an insulating material is arranged in the region of the entrance to the opening (6) so that it limits the lateral movement of the adapter.

10 Claims, 3 Drawing Sheets

(56) References Cited

FOREIGN PATENT DOCUMENTS

| | | | |
|---|---|---|---|
| CN | 101982903 | A | 3/2011 |
| CN | 102255193 | A | 11/2011 |
| EP | 1 207 592 | A2 | 5/2002 |
| EP | 2 273 623 | A1 | 1/2011 |
| GB | 2 193 853 | A | 2/1988 |
| JP | 2000-277217 | A | 10/2000 |
| WO | WO 00/52788 | A1 | 9/2000 |
| WO | WO 2011/015992 | A1 | 2/2011 |
| WO | WO 2011/088902 | A1 | 7/2011 |

* cited by examiner

PRINTED CIRCUIT BOARD COAXIAL CONNECTOR

BACKGROUND OF THE INVENTION

1. Field of the Invention

The present invention relates to the field of coaxial connectors for printed circuit boards.

After printed circuit boards have been fitted with SMD (Surface Mounted Device) components and have been subsequently soldered, printed circuit boards are contacted to one another at high frequencies. In this regard, locational and positional inaccuracies in the radial and axial direction have to be compensated for so that the high frequency properties are not lost. In general, a plurality of contact points are to be connected at the same time. For this purpose, coaxial connectors are used which can be blind-plugged and which interconnect two coaxial contact points which are arranged locally above one another, taking the axial and radial offset into account. Examples of coaxial con-tact points include coaxial cables, printed boards having corresponding layout structures, and housing lead-ins such as filter or duplexer couplings.

2. Discussion of Related Art

Printed circuit board coaxial connectors that can be blind-plugged are known from the prior art. These have a multi-layer construction having a first and a second connector part which are operatively interconnected via an adapter piece. A disadvantage of the connectors known from the prior art is that they have a fault, depending on the location, which can have a negative effect on the transmission properties.

WO2011/088902 from the same applicant was published on Jul. 28, 2011 and relates to a printed circuit board coaxial connector of the generic type. The connector comprises a first and a second connector part which can be operatively interconnected via an adapter piece. At least one connector side comprises mechanical operative connection means which "rigidly" interconnect the corresponding connector part and the associated end of the adapter, i.e. under normal circumstances, the connection is no longer releasable at all or is only releasable with increased force. The operative connection means are arranged with respect to the conductors such as to allow for an offset in the axial and lateral direction that is as large as possible.

U.S. Pat. No. 5,980,290 from the company Radiall was published in 1998 and describes a coaxial connector having a spherical joint insert. A ring is inserted into an end of a connector part and anchored here. Said ring prevents the joint insert from falling out of the connector part.

U.S. Pat. No. 4,925,403 from the company Gilbert Engineering Co. was published in 1988 and discloses a coaxial connector of the described type having an adapter piece. The connector is designed such that it can compensate for a certain lateral offset. A mechanical snap-in connection is created by means of an outer conductor of the adapter piece.

U.S. Pat. No. 5,879,177 from the company NEC Co. discloses another connector having a first and a second connector part, which can be operatively connected by an adapter piece. The adapter piece is used to compensate for a certain lateral offset.

WO0052788A1 from the same applicant was published in 2000 and discloses an improved connector of the generic type. The connector comprises a first and a second connector part, which can be operatively connected by means of an adapter piece. A ball joint is used on at least one side in order to reduce resulting forces.

EP1207592 from the company Rosenberger was published in 2002 and relates to a coaxial plug arrangement having a first and a second coaxial plug connector and a contact bush which connects said plug connectors. The contact bush is formed such that it can be tilted laterally in a predetermined region. The first coaxial plug connector and the contact bush comprise a latch connection in the region of their outer conductors. The latch connection in the region of the outer conductors has a limiting effect on the freedom of movement. All the first coaxial plug connectors are arranged in a common first plastics housing and all the second coaxial plug connectors are arranged in a common second plastics housing.

Additional connectors having a generic are known from US2004038586, US2007026698A, US2006194465A, CN2879475Y and CN101459304A.

None of the intellectual property rights known from the prior art give any suggestion as to how the transmission properties of the connector can be improved.

SUMMARY OF THE INVENTION

It is an object of the invention to disclose a connector of the generic type that has improved transmission properties.

This object is achieved by the connector defined in the independent claim.

The connectors known from the prior art are used inter alia in transceiver devices. For example, transmitted and received signals are routed together to special coaxial connections. Transmitted and received signals differ on account of the use of a frequency spectrum defined in each case. To achieve interference-free operation, it is imperative that no parts of the transmitted signal spectrum fall into the received signal spectrum. This behaviour also has to be provided for vibration and/or impact loads. Examples of possible sources of such interfering signals from the transmitted signal are passive intermodulation owing to poor or a plurality of mechanical contacts.

An additional mechanism for generating interfering signals results from the phase or frequency modulation of the transmitted signal. This effect can be generated by weak output of the transmitted signal in a resonant structure, the resonance frequency of which can be varied for example by vibration or mechanical impacts. Resonant structures can arise in a connector as a result of a plurality of contact points being arranged unfavourably with respect to one another, which have a particularly negative effect with ever increasing frequencies. These problems can occur in particular in connectors of the type according to the invention which are designed to compensate for geometric deviations and thus have a variable geometry. The connector according to the invention prevents negative effects and thus improves the transmission of the signals, in particular at high frequencies. The interfering output of the transmitted signal at the outer conductor of the connection element is thus reduced to the extent that it no longer has any negative effect.

In the connectors known from the prior art, a geometrically variable resonance chamber, which has a negative effect of the transmission properties, is formed at certain positions owing to the geometry of the outer conductor of the connection element (adapter) and the connector parts which are operatively connected thereto and together ensure axial and radial movability of the connector. The adapter interacts, via spring tongues arranged in an annular manner, with an inner surface of an opening in an electrically conductive housing of a coupled connector part. In this case, the resonance frequency is tuned out in that, in the event of a lateral deflection (tilting) of the adapter, the outer conductor of the adapter (which is at a distance from the spring tongues) approaches an edge of the electrically conductive housing of the coupled connector part. As soon as the distance between the edge of the housing and the outer conductor of the adapter exceeds a certain amount, a resonant circuit is created which capacitively loads the resonator and leads to the resonance frequency being influenced.

A connector according to the invention avoids this problem in that it comprises a limiting element, for example in the form of a limiting ring, which reduces the maximum lateral deflection (tilt movement) of the adapter with respect to the at-risk connector part. One embodiment of a connector according to the invention which avoids this problem comprises a first and a second connector part and an adapter which is arranged between said connector parts when assembled and can be coupled to the first and the second connector part in an electrically conductive manner and is used for operatively connecting the two connector parts in a jointed manner. The first and the second connector parts each have an inner conductor and an outer conductor, which are held with respect to one another by an insulator. The adaptor likewise comprises an inner conductor and an outer conductor, which are held with respect to one another by an insulator. The outer conductor of the first or second connector part has an opening in each case, which is designed so that the adapter can be inserted therein so as to be movable. At its two ends, the outer conductor of the adapter comprises resilient spring tongues having radially projecting contact ridges, which, when assembled, are inserted into the openings of the first or second connector part and interact here in an electrically conductive manner with contact surfaces. The resilient spring tongues are used together with the contact ridges to produce and maintain a secure electrical connection. At least one of the openings, used for inserting the adapter, in the outer conductor of the first or second connector part comprises a limiting element along one edge, preferably a limiting ring which consists of a non-conductive material. The limiting ring is used to limit the maximum possible lateral deflection of the adapter with respect to the corresponding connector part and to set the minimum possible distance between the outer conductor of the adapter and the outer conductor of the connector part. The limiting ring is used to prevent harmful resonant structures. The limiting ring can extend beyond the total width of the housing of a connector part, or can form a part thereof. The limiting ring can be attached to the housing of the connector part for example by being snapped in or screwed.

In one embodiment, the coaxial connector comprises a first and a second connector part and an adapter arranged therebetween. When assembled (operatively connected), the adapter is arranged in an opening of an outer conductor of the first connector part such that it can tilt laterally. An outer conductor of the adapter interacts, in an annular manner, with the outer conductor of the first connector part, for example via resilient spring tongues. Other operative connections are possible, so long as at least the lateral movability is not restricted. A limiting element made of a non-conductive material is arranged in the region of the entrance to the opening. It is used to limit the lateral deflection of the adapter in a controlled manner. The limiting element is advantageously designed in an annular manner and comprises a hole. According to the embodiment, the hole can be cylindrical or conical. Other configurations are possible. The limiting element can be arranged in a recess of the outer conductor of the first connector part. The limiting element can be attached in the recess for example by being pressed and/or snapped and/or glued in. The limiting element can, however, also be a part of an outer housing of the first connector part. In this case, the outer conductor of the first connector part can be pressed and/or snapped and/or glued into the limiting element. The limiting element is advantageously produced from plastics material. Other insulating materials are possible. For example the limiting element can be produced from a resilient material which exerts a restoring force on the adapter when deformed thereby. The outer conductor of the adapter can comprise a circumferential ridge which interacts with the limiting element in a defined manner and determines the maximum lateral deflection thereof.

BRIEF DESCRIPTION OF THE DRAWINGS

The invention will now be described below in greater detail on the basis of figures which merely show embodiments and in which.

Unless stated otherwise, the same reference numerals are used in the figures for corresponding regions/parts.

DETAILED DESCRIPTION OF THE INVENTION

Figure 1:
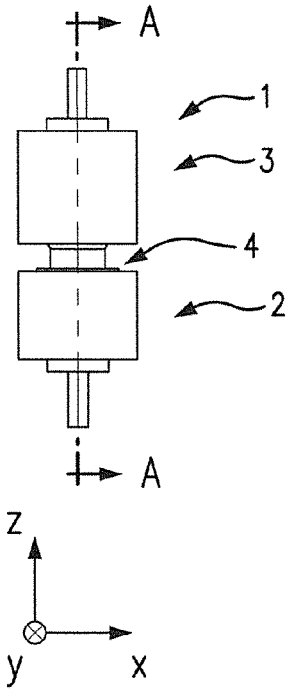
FIG. 1 is a side view of an assembled connector according to the invention.

FIG. 1 shows a coaxial connector 1 according to the invention having a first connector part 2, a second connector part 3 and an adapter 4, which is used to operatively connect the first connector part 2 to the second 3, in the coupled state. The connector parts 2, 3 and the adapter 4 are constructed in a coaxial manner.

Figure 2:
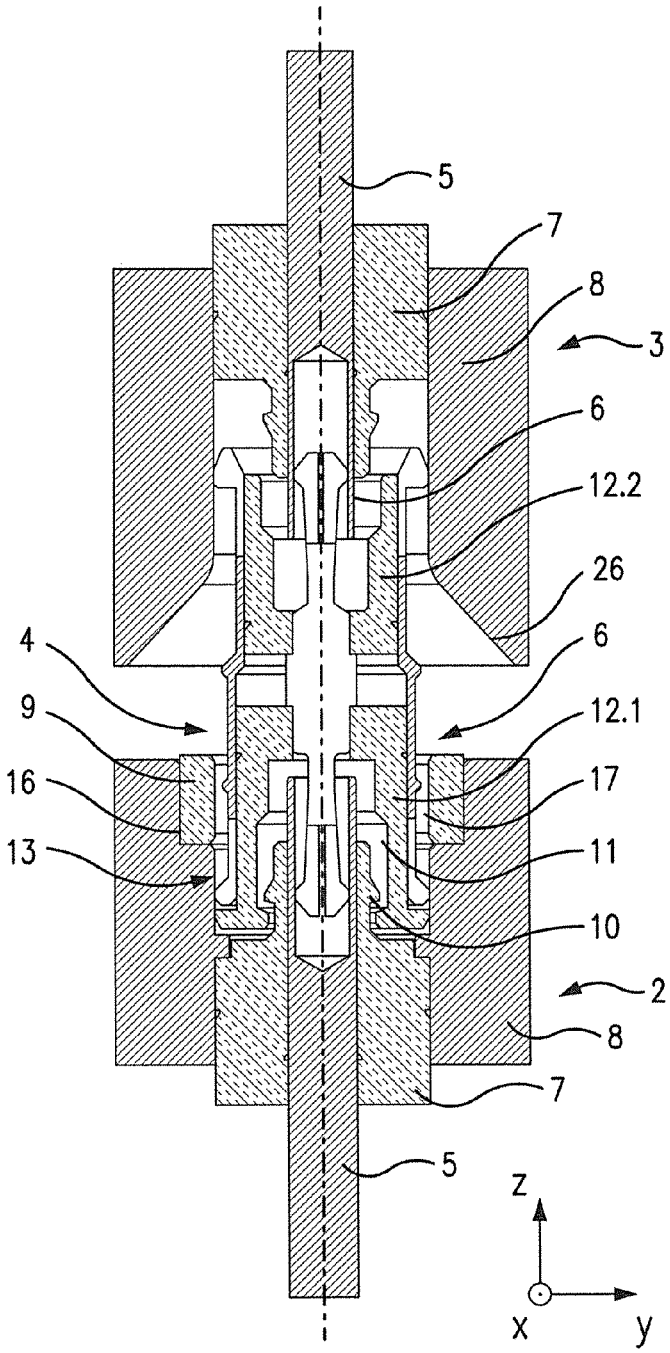
FIG. 2 is a sectional view through the connector according to FIG. 1.
Figure 3:
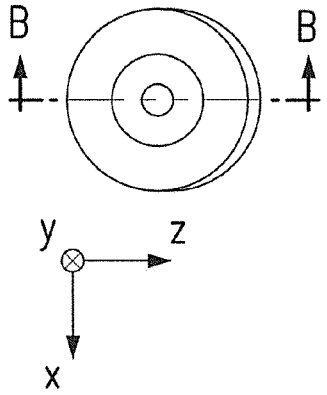
FIG. 3 is a plan view of the connector according to FIG. 1 in a deflected position.
Figure 4:
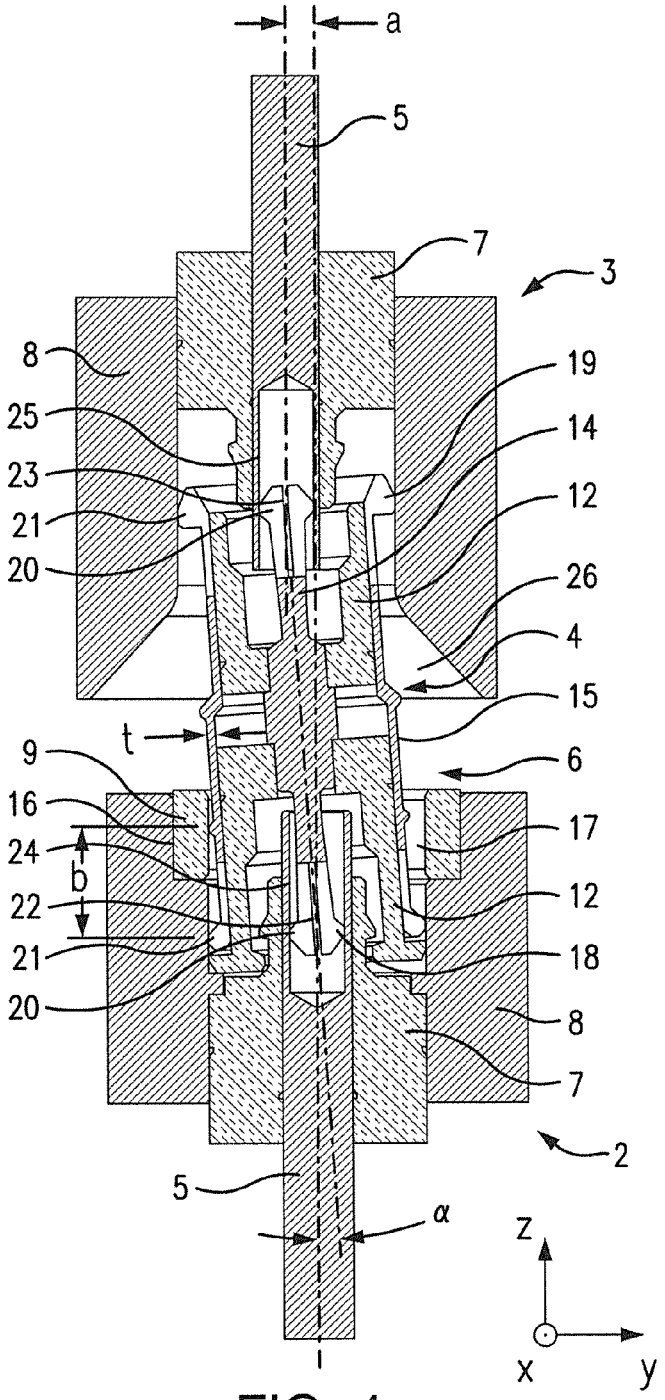
FIG. 4 is a sectional view through the connector according to FIG. 3 along the sectional line BB.

FIG. 1 is a front view of the coaxial connector 1 in the operatively connected state. FIG. 2 is a sectional view through the connector 1 along the sectional line AA according to FIG. 1, The connector is not deflected in FIG. 1 and FIG. 2. FIG. 3 is a plan view of the connector and FIG. 4 is a sectional view through the connector 1 along the sectional line BB according to FIG. 3. The connector parts 2, 3 are arranged deflected (offset) relative to one another by the distance a. The offset is compensated for by the adapter 4.

In the embodiment shown, the first and the second connector parts 2, 3 have a substantially identical construction. If necessary, it is possible to configure the first and second connector parts 2, 3 to not be identical, according to requirements.

The first and the second connector parts 2, 3 each comprise a cylindrical inner conductor 5 which is designed in each case in a sleeve-like manner at the front end thereof. The inner conductor 5 is positioned and held with respect to an outer conductor 8 by an insulator 7. The outer conductor 8, which in this case simultaneously acts as the housing of the connector part 2, 3, comprises an opening 6 which, in the embodiment shown, is cylindrical and arranged coaxially with the inner conductor 5. The inner conductor 5 is arranged inside the opening 6 of the outer conductor 8. Other configurations are possible.

As can be seen in FIG. 2, the first insulator 7 extends along the first inner conductor 5 and forms a substantially cylindrical sleeve region 17, which in this case abuts the inner conductor 5 and on which is formed an outwardly projecting annular retaining ridge 10 (first operative connection means). When assembled, the retaining ridge 10 engages in an annular groove 11 (second operative connection means) of an insulator 12 (a two-part insulator in this case) of the adapter 4 and forms therewith a jointed mechanical connection 13 in the lateral direction. The mechanical connection 13 is generally designed as a releasable snap-in connection and allows the adapter 4 to be disconnected from the first connector part 2 by applying a particular force in the axial direction (the z-direction in this case).

Figure 5:
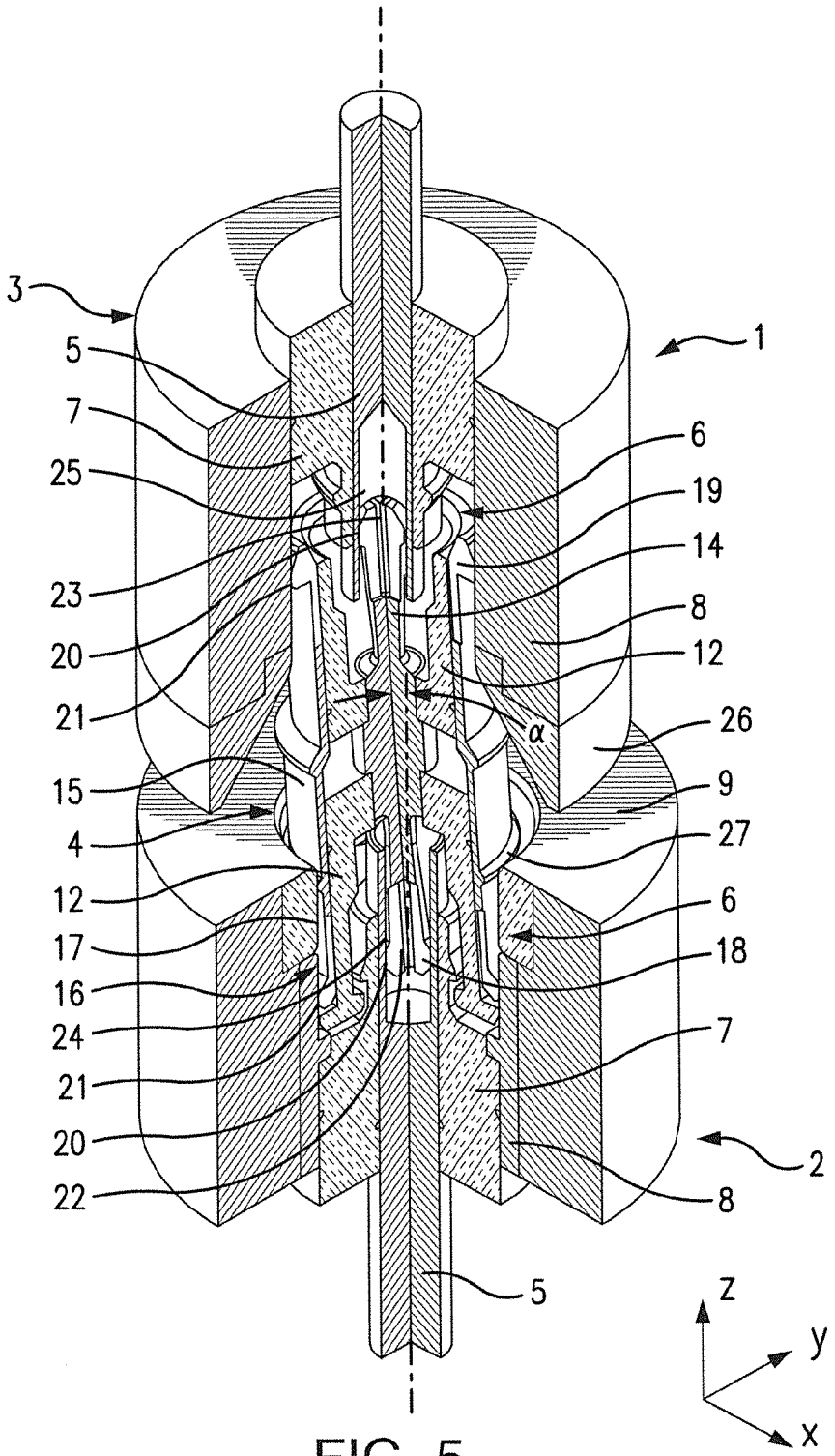
FIG. 5 is a perspective sectional view through a second embodiment of a connector according to the invention.

As can be seen in FIGS. 2, 3 and 5, in the embodiment shown the insulator 12 of the adapter 4 is formed in two parts and, referring to the figure, comprises a first upper part and a second lower part 12.1, 12.2. The insulator 12 positions an inner conductor 14 of the adapter 4 with respect to an outer conductor 15 of the adapter 4. At their ends, both the inner and the outer conductors 14, 15 respectively comprise inner or outer spring tongues 18, 19 which comprise on their circumference first and second contact ridges 20, 21, which are formed to project out circumferentially. To keep the forces low, the outer surfaces of the contact ridges 20, 21 are advantageously spheroidal. The spring tongues 18, 19 are functionally separated in the circumferential direction by slits 22, 23 and can spring in the radial direction. When connected, the contact ridges 20, 21 form a substantially annular contact with inner first and second contact surfaces 24, 25 of the inner conductor 5 and the outer conductor 8 of the connector parts 2, 3. The configuration of the mechanical connection 13 or of the spring tongues 18, 19 allows the adapter 4 to tilt in the lateral direction by a certain angle $\alpha$ with respect to the first connector part 2 (cf. FIGS. 3 and 5). At its free end, the outer conductor 8 of the first connector part 2 comprises an annular limiting element 9 which is produced for example from plastics material and in the embodiment shown is pressed into a recess 16 in the outer conductor 8 of the first connector part 2. The limiting element 9 limits the maximum possible lateral tilt angle a of the adapter 4 with respect to the first connector part 2, in that the limiting element 9 comes into contact with an annular ridge 27 formed on the outer conductor 8 of the adapter 4. Other configurations are possible. The distance b between the contact ridge 21 of the outer conductor 15 and the annular ridge 27 is set such that the maximum possible angle $\alpha$ does not exceed a certain amount. The position of the ridge 27 defines the contact point between the outer conductor and the limiting element 9. The minimum possible distance t (cf. FIG. 5) between the electrically conductive second outer conductor 15 of the adapter 4 and the electrically conductive first outer conductor 8 is limited by the limiting element 9 such that the from the problem as a result of a plurality of contact points and the resulting feedback is reduced. Since the limiting element prevents the minimum distance t from dropping below a certain amount, the otherwise occurring phase deviation of the phase modulation is reduced. In the embodiment shown, the second connector part 3 comprises a funnel 26 which is moulded on its outer conductor 8 and simplifies assembly. In particular in the case of adapters 4 positioned at an angle or if a lateral offset occurs during assembly, the funnel 26 serves as an assembly aid in that it safely guides the free end of the adapter 4 into the opening, provided therefore, in the inner conductor 8.

FIG. 5 is a perspective view of a further embodiment of a connector 1. The basic principle of the connector 1 corresponds to that of FIG. 1-3. Unless stated otherwise, like parts have like reference numerals. The connector parts 2, 3 and the adapter 4 are shown in a perspective view from diagonally above. For the sake of comprehension, the connector parts 2, 3, and the adapter 4 are shown in section, so that the inner conductor can be seen. In FIG. 5, the connector parts 2, 3 are (laterally) offset from one another, the offset being compensated for by the adapter 4. Unlike in the first embodiment according to FIG. 1-4, the limiting element 9 in this case forms an outer housing of the first connector part 2. The outer conductor 8 is pressed into the limiting element 9 from below. The limiting element 9 is advantageously produced from plastics material. Another difference is that a funnel 26 made of plastics material is attached to the outer conductor 8 of the second connector part 3 and is used as the limiting element to deflect or laterally tilt the adapter 4. When the connector parts are plugged together, the funnel 26 is used to insert the adapter 4 into the opening 6 in the outer conductor 8 of the second connector part 3.

The invention claimed is:

1. A coaxial connector (1) comprising:

a. a first connector part (2) and a second connector part (3) and an adapter (4) arranged therebetween, wherein, b. when assembled, the adapter (4) is arranged in an opening (6) an outer conductor (8) of the first connector part (2) to tilt laterally, and wherein c. a limiting element (9) made of an insulating material is arranged between the outer conductor (8) of the first connector part (2) and a second outer conductor (15) of the adapter (4) in a region of the entrance of the opening (6), and d. limits the lateral deflection of the adapter (4) and the minimal possible distance between the second outer conductor (15) of the adapter (4) and the outer conductor (8) of the first connector part (2).

2. The coaxial connector (1) according to claim 1, wherein the limiting element (9) is annular and comprises a hole (17).

3. The coaxial connector (1) according to claim 2, wherein the hole (17) is cylindrical or conical.

4. The coaxial connector (1) according to claim 1, wherein the limiting element (9) is arranged in a recess (16) in the outer conductor (8) of the first connector part (2).

5. The coaxial connector (1) according to claim 4, wherein the limiting element (9) is at least one of pressed, snapped and glued into the recess (16).

6. The coaxial connector (1) according to claim 1, wherein the limiting element (9) is a part of an outer housing of the first connector part (2).

7. The coaxial connector (1) according to claim 6, wherein the outer conductor (8) of the first connector part (2) is pressed into the limiting element (9).

8. The coaxial connector (1) according to claim 1, wherein the limiting element (9) is produced from plastics material.

9. The coaxial connector (1) according to claim 1, wherein the limiting element (9) is produced from a resilient material which exerts a restoring force on the adapter (4) when deformed thereby.

10. The coaxial connector (1) according to claim 1, wherein an outer conductor (15) of the adapter (4) comprises a circumferential ridge (27) which interacts with the limiting element (9).

* * * * *